US006006384A

United States Patent [19]

Toal

[11] Patent Number: 6,006,384

[45] Date of Patent: Dec. 28, 1999

[54] DRYWALL KNIFE WITH SCREWDRIVER

[76] Inventor: Kelly M. Toal, 493 S. Ogden St., Buffalo, N.Y. 14206

[21] Appl. No.: 09/044,323

[22] Filed: Mar. 19, 1998

[51] Int. Cl.[6] ..... B25F 1/00

[52] U.S. Cl. ..... 7/105; 7/144; 7/158; 7/165; 7/167

[58] Field of Search ..... 7/105, 143–144, 7/158, 165, 167; 81/177.4, 490, 438–439; 30/169; 15/236.01, 245.1; D32/46

[56] References Cited

U.S. PATENT DOCUMENTS

| | | | |
|---|---|---|---|
| 136,450 | 3/1873 | Murch | 7/165 X |
| 832,455 | 10/1906 | Christensen | 7/105 |
| 1,277,767 | 9/1918 | Stafford | 7/105 |
| 1,779,293 | 10/1930 | Rodgers | 7/105 X |
| 1,980,087 | 11/1934 | Rast | 81/489 |
| 3,078,491 | 2/1963 | Ames . | |
| 4,762,036 | 8/1988 | Orlitzky et al. | 81/177.4 X |
| 5,063,627 | 11/1991 | Marra | 7/105 |
| 5,556,092 | 9/1996 | Theken | 7/167 X |
| 5,711,194 | 1/1998 | Anderson et al. | 81/440 |
| 5,720,063 | 2/1998 | Chacon | 7/105 X |
| 5,809,600 | 9/1998 | Cachot | 7/128 |

*Primary Examiner*—D. S. Meislin

[57] ABSTRACT

A drywall knife with screwdriver is provided including a drywall blade and a handle coupled to the blade. The handle is equipped with a bore formed therein. A screwdriver is removably situated within the bore.

7 Claims, 2 Drawing Sheets

DRYWALL KNIFE WITH SCREWDRIVER

BACKGROUND OF THE INVENTION

1. Field of the Invention

The present invention relates to dry wall tools and more particularly pertains to a new drywall knife with screwdriver for allowing the convenient use of a screwdriver during dry wall related work.

2. Description of the Prior Art

The use of dry wall tools is known in the prior art. More specifically, dry wall tools heretofore devised and utilized are known to consist basically of familiar, expected and obvious structural configurations, notwithstanding the myriad of designs encompassed by the crowded prior art which have been developed for the fulfillment of countless objectives and requirements.

Known prior art dry wall tools include U. S. Pat. No. 5,063,627; U.S. Pat. No. 4,620,369; U.S. Pat. No. 5,272,782; U.S. Pat. No. 4,794,694; and U.S. Pat. Des. 268,085.

In these respects, the drywall knife with screwdriver according to the present invention substantially departs from the conventional concepts and designs of the prior art, and in so doing provides an apparatus primarily developed for the purpose of allowing the convenient use of a screwdriver during dry wall related work.

SUMMARY OF THE INVENTION

In view of the foregoing disadvantages inherent in the known types of dry wall tools now present in the prior art, the present invention provides a new drywall knife with screwdriver construction wherein the same can be utilized for allowing the convenient use of a screwdriver during dry wall related work.

The general purpose of the present invention, which will be described subsequently in greater detail, is to provide a new drywall knife with screwdriver apparatus and method which has many of the advantages of the dry wall tools mentioned heretofore and many novel features that result in a new drywall knife with screwdriver which is not anticipated, rendered obvious, suggested, or even implied by any of the prior art dry wall tools, either alone or in any combination thereof.

To attain this, the present invention generally comprises a blade having a planar configuration. A periphery of the blade is defined by an outboard extent formed of a linear sharpened outboard edge and a pair of side edges. Such side edges are equipped with linear outboard portions which remain in parallel relationship and arcuate inboard portions tapering inward. As shown in FIG. 1, the arcuate inboard portions each have a length at least twice that of the outboard portions of the outboard extent. The periphery is further defined by an inboard extent having a rectangular configuration with a length equal to that of the outboard extent and a width equal to about ⅓ that of the outboard edge of the outboard extent of the blade. Next provided is a handle having a generally rectangular configuration with a top face, a bottom face and a periphery formed therebetween. The periphery is defined by an inboard face, an outboard face, and a pair of elongated side faces. As shown in FIG. 2, the outboard face has a thin rectangular slot formed therein. The slot extends through a majority of the handle for receiving the inboard extent of the blade. The side faces of the handle each have a plurality of aligned undulations formed along an entire length thereof for gripping purposes. The top face of the handle has a recess formed therein with aligned linear elongated ends and a central portion with an oval configuration. A first one of the side faces has a bulbous protrusion formed therein adjacent to the inboard face of the handle. A second one of the side faces has a circular bore formed therein adjacent to the inboard face of the handle. The circular bore is situated about an axis which resides at a 45 degree angle with respect to the handle. Lastly, a screwdriver is provided having a cylindrical configuration. The screwdriver is equipped with a pair of ends each with a screwdriver bit formed thereon. A central extent of the screwdriver is equipped with a plurality of diametrically opposed locking tabs coupled thereto and extending radially therefrom. The screwdriver is adapted to be removably secured within the recess of the handle for storage purposes and removably situated within the bore of the handle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new drywall knife with screwdriver apparatus and method which has many of the advantages of the dry wall tools mentioned heretofore and many novel features that result in a new drywall knife with screwdriver which is not anticipated, rendered obvious, suggested, or even implied by any of the prior art dry wall tools, either alone or in any combination thereof.

It is another object of the present invention to provide a new drywall knife with screwdriver which may be easily and efficiently manufactured and marketed.

It is a further object of the present invention to provide a new drywall knife with screwdriver which is of a durable and reliable construction.

An even further object of the present invention is to provide a new drywall knife with screwdriver which is susceptible of a low cost of manufacture with regard to both materials and labor, and which accordingly is then susceptible of low prices of sale to the consuming public, thereby making such drywall knife with screwdriver economically available to the buying public.

Still yet another object of the present invention is to provide a new drywall knife with screwdriver which provides in the apparatuses and methods of the prior art some of the advantages thereof, while simultaneously overcoming some of the disadvantages normally associated therewith.

Still another object of the present invention is to provide a new drywall knife with screwdriver for allowing the convenient use of a screwdriver during dry wall related work.

Even still another object of the present invention is to provide a new drywall knife with screwdriver that includes a drywall blade and a handle coupled to the blade. The handle is equipped with a bore formed therein. A screwdriver is removably situated within the bore.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
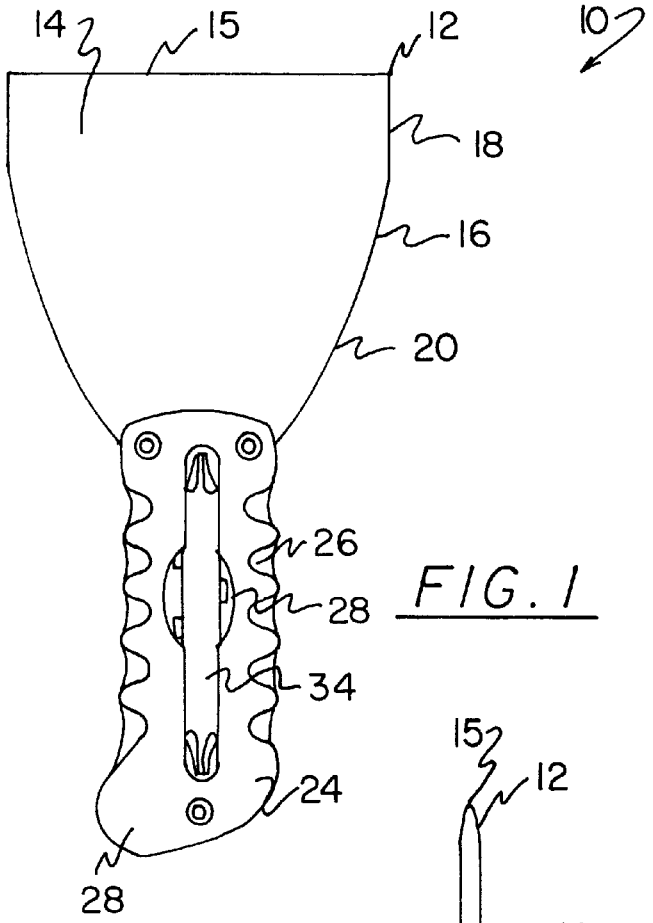
FIG. 1 is a front view of a new drywall knife with screwdriver according to the present invention.

With reference now to the drawings, and in particular to FIGS. 1 through 4 thereof, a new drywall knife with screwdriver embodying the principles and concepts of the present invention and generally designated by the reference numeral 10 will be described.

The present invention, designated as numeral 10, includes a blade 12 having a planar configuration. A periphery of the blade is defined by an outboard extent 14 formed of a linear sharpened outboard edge 15 and a pair of side edges 16. Such side edges are equipped with linear outboard portions 18 which remain in parallel relationship with respect to each other and perpendicular with respect to the outboard edge. The side edges further have arcuate inboard portions 20 tapering inward. As shown in FIG. 1, the arcuate inboard portions each have a length at least twice that of the outboard portions of the outboard extent. The periphery is further defined by an inboard extent 22 having a rectangular configuration with a length equal to that of the outboard extent and a width equal to about ⅓ that of the outboard edge of the outboard extent of the blade.

Figure 2:
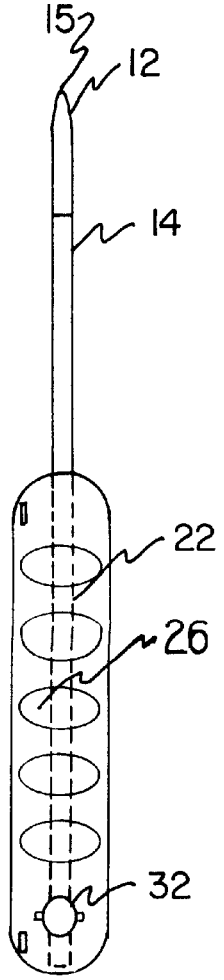
FIG. 2 is a side view of the present invention with the slot of the outboard face of the handle illustrated in breakaway.

Next provided is a handle 24 having a generally rectangular configuration with a top face 38, a bottom face 39 and a periphery formed therebetween. The periphery is defined by an inboard face 40, an outboard face 41, and a pair of elongated side faces 42,43. As shown in FIG. 2, the outboard face has a thin rectangular slot 44 formed therein. The slot extends through a majority of the handle for receiving the inboard extent of the blade. As shown in FIG. 1, rivets 45 are preferably employed to secure the handle to the blade.

The side faces of the handle each have a plurality of aligned undulations 26 formed along an entire length thereof for gripping purposes. The top face of the handle has a recess 28 formed therein with aligned linear elongated ends 48, 49 and a central portion 50 with an oval configuration for reasons that will become apparent hereinafter. The linear elongated ends of the recess preferably extend along an axis associated with the handle and further have a length approximately equal to that of the handle.

A first one of the side faces of the handle has a bulbous protrusion 30 formed therein adjacent to the inboard face of the handle. Such bulbous protrusion extends both downwardly and outwardly from the handle for striking nails and dimpling. As an option, the bulbous protrusion may be formed of brass. A second one of the side faces of the handle has a cylindrical bore 32 formed therein adjacent to the inboard face of the handle. The circular bore is situated about an axis which resides at a 45 degree angle with respect to the handle.

Figure 4:
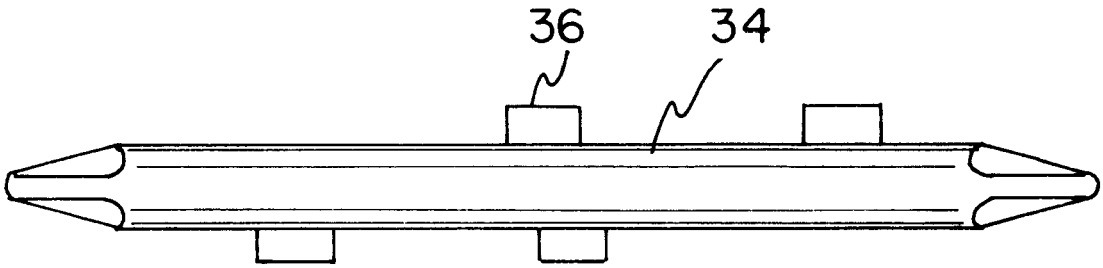
FIG. 4 is a side view of the screwdriver of the present invention.

Lastly, a screwdriver 34 is provided having a cylindrical configuration and a length approximately equal to that of the handle. The screwdriver is equipped with a pair of ends each with a Philips style screwdriver bit formed thereon. A central extent of the screwdriver is has a plurality of diametrically opposed planar locking tabs 36 coupled thereto and extending radially therefrom in coplanar relationship with an axis about which the screwdriver is situated. As illustrated in FIG. 4, each side of the screwdriver may have a central locking tab 36*a*,36*b* and an end locking tab 36*c*,36*d* situated on opposite ends.

Figure 3:
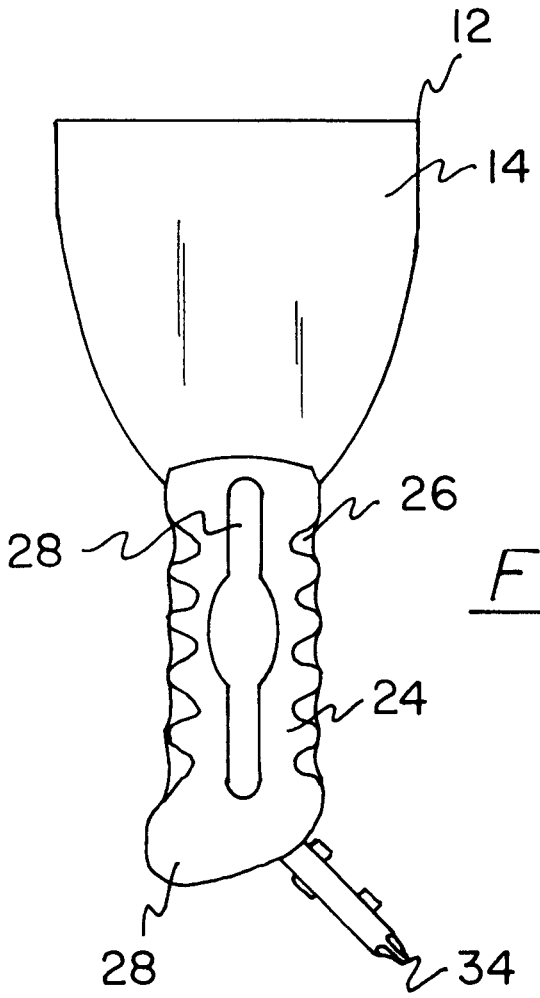
FIG. 3 is a breakaway front view of the present invention with the screwdriver being inserted into the bore to position it in its deployed position.

The screwdriver is adapted to be removably secured within the recess of the handle for storage purposes. The recess is preferably equipped with unillustrated detents for engaging the locking tabs of the screwdriver. As best illustrated in FIG. 3, in a deployed mode one end of the screwdriver may be inserted into the bore of the handle. The bore has a pair of diametrically opposite longitudinal slots 46,47 for receiving the locking tabs of the screwdriver therein. Detents may also be used in the bore for securing the screwdriver therein. In the alternative, spring-biased ball bearings or the like may be employed to accomplish the same. In use, about ½ a length of the screwdriver extends downwardly and outwardly from the handle.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A drywall knife with screwdriver comprising, in combination:

a blade having a planar configuration with a periphery defined by an outboard extent formed of a linear sharpened outboard edge and a pair of side edges with linear outboard portions which remain in parallel relationship and arcuate inboard portions tapering inward and having a length at least twice that of the outboard portions of the outboard extent, the periphery further defined by an inboard extent having a rectangular configuration with a length equal to that of the outboard extent and a width equal to about ⅓ that of the outboard edge of the outboard extent of the blade;

a handle having a generally rectangular configuration with a top face, a bottom face and a periphery formed therebetween defined by an inboard face, an outboard face, and a pair of elongated side faces, the outboard face having a thin rectangular slot formed therein which extends through a majority of the handle for receiving the inboard extent of the blade, the side faces each having a plurality of aligned undulations for gripping purposes, the top face of the handle having a recess formed therein with aligned linear elongated ends and a central portion with an oval configuration, a first one of the side faces having a bulbous protrusion formed therein adjacent to the inboard face of the handle, a second one of the side faces having a circular bore formed therein adjacent to the inboard face of the handle and situated about an axis which resides at a 45 degree angle with respect to the handle;

a screwdriver having a cylindrical configuration with a pair of ends each with a screwdriver bit formed thereon and a central extent with a plurality of diametrically opposed locking tabs coupled thereto and extending radially therefrom;

wherein the screwdriver is positionable in a stored position and a deployed position;

the recess of the handle receiving therein the screwdriver when the screwdriver is positioned in the stored position, the locking tabs of the screwdriver being located in the central portion of the recess when the screwdriver is position in the stored position; and one end of the screwdriver being inserted into the bore of the handle with the screwdriver is positioned in the deployed position such that the other end of the screwdriver is outwardly extended away from the handle at a 45 degree angle with respect to the handle, the bore of the handle having a pair of diametrically opposite longitudinal slots, at least one of the longitudinal slots of the bore receiving therein at least one of the locking tabs of the screwdriver when the screwdriver is positioned in the deployed position.

2. A drywall knife with screwdriver, comprising:

a blade having an inboard extent;

a handle having top and bottom faces, inboard and outboard faces;

the outboard face receiving therein the inboard extent of the blade;

the top face of the handle having a recess formed therein with aligned linear elongated ends and a central portion with an oval configuration;

the handle having a circular bore formed therein adjacent to the inboard face of the handle;

a screwdriver having a pair of ends and a central extent with a plurality of locking tabs extending radially therefrom;

wherein the screwdriver is positionable in a stored position and a deployed position;

the recess of the handle receiving therein the screwdriver when the screwdriver is positioned in the stored position, the locking tabs of the screwdriver being located in the central portion of the recess when the screwdriver is position in the stored position; and one end of the screwdriver being inserted into the bore of the handle with the screwdriver is positioned in the deployed position such that the other end of the screwdriver is outwardly extended away from the handle at a 45 degree angle with respect to the handle, the bore of the handle having a pair of diametrically opposite longitudinal slots, at least one of the longitudinal slots of the bore receiving therein at least one of the locking tabs of the screwdriver when the screwdriver is positioned in the deployed position.

3. The drywall knife with screwdriver of claim 2, wherein the blade has a planar configuration with a periphery defined by an outboard extent formed of a linear sharpened outboard edge and a pair of side edges with linear outboard portions which remain in parallel relationship and arcuate inboard portions tapering inward and having a length at least twice that of the outboard portions of the outboard extent.

4. The drywall knife with screwdriver of claim 3, wherein the inboard extent has a length equal to that of the outboard extent and a width equal to about ⅓ that of the outboard edge of the outboard extent of the blade.

5. The drywall knife with screwdriver of claim 2, wherein the handle has a pair of elongated side faces each having a plurality of aligned undulations for gripping purposes.

6. The drywall knife with screwdriver of claim 5, wherein a first one of the side faces has a bulbous protrusion formed therein adjacent to the inboard face of the handle, and wherein the bore of the handle is located adjacent a second one of the side faces.

7. The drywall knife with screwdriver of claim 2, wherein the bore of the handle has an axis extending at a 45 degree angle with respect to the handle.

* * * * *